United States Patent [19]

Rosemeier et al.

[11] 4,342,420

[45] Aug. 3, 1982

[54] DEVICE FOR SEPARATING LIQUIDS, ESPECIALLY WHOLE BLOOD

[75] Inventors: Friedrich Rosemeier; Helmut Kerber, both of Hechingen, Fed. Rep. of Germany

[73] Assignee: Gambro Dialysatoren KG, Fed. Rep. of Germany

[21] Appl. No.: 191,254

[22] Filed: Sep. 26, 1980

[30] Foreign Application Priority Data

Sep. 28, 1979 [SE] Sweden ..... 7908036

[51] Int. Cl.[3] ..... B04B 3/00

[52] U.S. Cl. ..... 233/28

[58] Field of Search ..... 233/26, 27, 20 R, 13, 233/28, 2, 35, 47 R, 19

[56] References Cited

U.S. PATENT DOCUMENTS 1,472,085 10/1923 Philip ..... 233/20 R X
3,698,626 10/1972 Kotrappa ..... 233/13 X
3,703,984 11/1972 Pruessner ..... 233/28
4,007,871 2/1977 Jones ..... 233/27
4,010,894 3/1977 Kellogg ..... 233/27

FOREIGN PATENT DOCUMENTS 1336965 11/1973 United Kingdom ..... 233/27

*Primary Examiner*—Billy J. Wilhite
*Attorney, Agent, or Firm*—Lerner, David, Littenberg & Samuel

[57] ABSTRACT

A rotatable rigid disc for separating a liquid into fractions according to the densities of such fractions is disclosed. The rigid disc includes an inlet for the liquid to be separated; at least two outlets for the separated liquid fractions; and a separation chamber in the form of an elongated, curved conduit. The conduit is fluidically connected to the inlet and the outlets, the outlets are positioned on the disc radially outwardly with respect to the inlet, and the outlets are positioned along the elongated, curved conduit so as to provide a separate collection location for each outlet and so that the densest fraction is separated by the outlet nearest to the inlet and the least dense fraction is separated by the outlet most distal from the inlet.

30 Claims, 4 Drawing Figures

DEVICE FOR SEPARATING LIQUIDS, ESPECIALLY WHOLE BLOOD

BACKGROUND OF THE INVENTION

The present invention relates in general to a device for separating of a liquid, especially whole blood, into fractions having different densities. More particularly, the invention relates to a device comprising a rotatable separation unit having inlet means to be connected to a source for the liquid to be separated and outlet means to be connected to collection points for the separated fractions.

U.S. Pat. No. 4,007,871 discloses a separation unit for use in a device to separate whole blood into fractions according to their respective densities. The separation unit according to this patent is formed of two circular sheets of flexible material, which are joined together to provide a generally annular separation chamber therebetween. An inlet tube is welded between the sheets to provide inlet means into said chamber for the liquid to be separated, and several outlet tubes are similarly welded between the sheets to provide outlet means for each of the separated fractions from a common collection portion of the separation chamber.

U.S. Pat. No. 4,010,894 relates to a similar separation unit. The main difference between the two separation units is that the separation chamber disclosed in the '894 patent is extended by an outer annular separation chamber in fluid communication with an inner separation chamber by means of a radial connecting channel. Even this separation unit, however, comprises two circular sheets of flexible material and several tubes welded between the two sheets.

A major disadvantage of these two known separation units is that mixing of the separated fractions may occur in the separation chamber due to the fact that the same collection portion is used to collect more than one fraction. Another disadvantage is the use of a great number of individual components (two sheets and at least three separate tubes), whereby inner as well as outer leakages may occur due to insufficient sealing (welding). In addition, the separation units may rupture as a result of an asymmetric liquid distribution in the separation chamber. The main reason for this is that the two sheets used in the device are formed of flexible material, as suggested on lines 20–23 in column 3 of U.S. Pat. No. 4,007,871.

SUMMARY OF THE INVENTION

It has now been found that good separation of a liquid, especially whole blood, into fractions having different densities can be provided by a device comprising a rotatable disc including an inlet for the liquid to be separated; at least two outlets for the separated liquid fractions; and a separation chamber in the form of an elongated, curved conduit, wherein the conduit is fluidically connected to the inlet and outlets, the outlets are positioned on the disc radially outwardly with respect to the inlet, and the outlets are positioned along the elongated, curved conduit so as to provide a separate collection location for each outlet and so that the most dense fraction is separated by the outlet nearest to the inlet and the least dense fraction is separated by the outlet most distal from the inlet.

The conduit may be an elongated, curved bore formed within the disc, but is preferably provided as a groove on the surface of one side of the disc. The disc thereby may be formed by molding without using tools having movable cores.

Preferably, the disc of the present invention is formed as a one single piece having a generally circular outer shape, whereby the disc has a convenient symmetrical shape for rotation when used in a device for centrifugal separation of a liquid. Furthermore, the disc may be easily mounted on or attached to a rotatable supporting means, forming part of the present device and adapted to cover the groove in the disc.

The disc may also include a central bore serving as an inlet in fluid communication with the groove, which bore may also provide a suitable seat for receiving a corresponding pin of a stationary transferring element which may be used in the device.

The groove preferably comprises an inlet portion in fluid communication with a peripheral main portion. The inlet portion preferably has a generally semi-circular shape leading from the inlet to the peripheral portion, and the peripheral portion has a shape generally curving about the periphery of the disc. This arrangement is especially advantageous from a separation point of view, since the liquid under convenient flowing conditions rapidly reaches the peripheral main part, where the main separation occurs. Due to the rapid transferring from the center of the disc to the periphery thereof, a certain preseparation will occur in the central semi-circular inlet portion of the groove. More precisely, at least part of the heaviest fraction of the liquid will concentrate towards the peripheral outer edge of the central semi-circular inlet portion and will follow the lines of this peripheral outer edge without being exposed to excessively violent bends while flowing towards the peripheral main portion.

To make use of the greatest possible centrifugal force during separation, the peripheral main portion is preferably provided concentrically to the center of the disc. In order to further enhance the efficiency of separation in the groove, the peripheral main portion may be extended by a radially inwardly curved end portion preferably having a smooth profile. The advantage of such an end portion will be explained further below.

The outlet means may be in the form of perforating holes in the disc, which are provided at separate locations along the peripheral main portion and/or the curved end portion of the groove. These holes are preferably in fluid communication with corresponding separate slits or channels on the other side of the disc for withdrawing the separated fractions.

Preferably, the groove comprises radially outwardly expanded sections at the holes along the peripheral main portion and/or curved end portion, e.g., the groove is wider radially outwardly at the point of and preceding the hole than at a point distal to such hole. Such holes are preferably provided at the respective end of the expanded sections while forming radial steps in the groove. The expanded sections thereby will form separate collection chambers for the heavier fractions, whereby said steps serve to retain said heavier fractions and to direct said fractions out through the associated holes. The lighter fractions, on the other hand, will flow past these collection chambers in a flowing path having an essentially non-reduced cross-section.

Especially in the separation of whole blood into a plasma-rich and a plasma-poor fraction, it is convenient for the outlet hole for the plasma-rich fraction to be provided in the curved end portion, preferably at the end point thereof. The outlet hole for the plasma-poor fraction is preferably provided in the peripheral main portion, more preferably in the vicinity of the curved end portion. The advantage of the above-discussed positioning of the outlet holes will be apparent from the following description.

In assembling a suitable device for separating of a liquid, especially whole blood, according to the present invention, the separation unit is placed on the top surface of supporting means, which are preferably planar. The supporting means are adapted to cover the groove in the disc and may be rotated by means of a motor via a drive shaft received in a suitable seat on the other surface of the supporting means. Preferably, the disc is centrally located on the supporting means and has its inlet opening or bore in register with the vertical drive shaft.

A transferring element having inlet and outlet channels is preferably centrally located on the disc by means of a suitable bearing so as to provide fluid communication between the inlet channel of the transferring element and the groove of the disc.

The package of supporting means, disc and transferring element is preferably covered by a housing having outlet passages in fluid communication with the slits or channels on the top surface of the disc and with the corresponding transferring outlet channels in the transferring element. The housing is attached in a fluid-tight manner to the disc and is preferably sealed around the outer periphery of the disc and the supporting means. The transferring element is preferably adapted to be held stationary during the rotation of the supporting means, disc and housing. This is achieved by means of a suitable bearing, such as a glass ball-bearing received in a seat between the housing, disc and supporting means at the bottom of the transferring element. To prevent outer leakage, a sealing between the transferring element and the housing may be provided at an upper end of the transferring element. Such a transferring element is described in detail in our copending U.S. application Ser. No. 191,253 filed on Sept. 26, 1980, and entitled "Transferring Means For Use In A Device For Separating Liquids", which corresponds to Swedish Patent Application No. 79.08037.0, filed Sept. 28, 1979, the disclosure of which applications is incorporated herein by reference.

Being so assembled, the combination of supporting means, separation unit or disc, housing and transferring element may be mounted on any already existing rotatable shaft by merely modifying the seat of the supporting means to fit the driving shaft, if necessary.

A major advantage of the above-discussed device is that it may be formed as a disposable package, already assembled, for immediate use. This is advantageous, since the user of the device merely has to connect a suitable tubing to the inlet and outlet channels of the transferring element, when the device has been mounted on the rotatable shaft.

BRIEF DESCRIPTION OF THE DRAWINGS

For further details of the present device, reference is made to the following description taken in connection with the accompanying drawings, wherein.

DETAILED DESCRIPTION OF THE INVENTION

Figure 1:
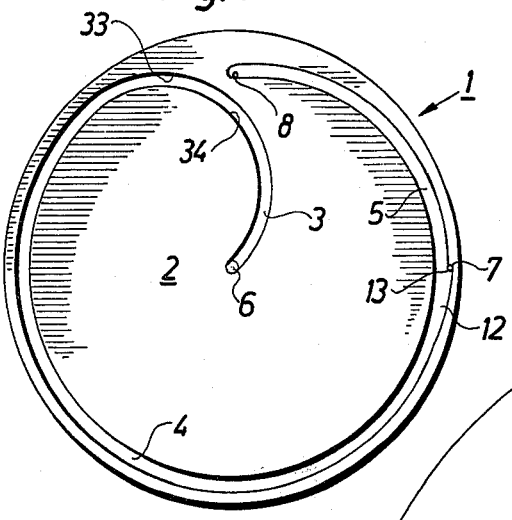
FIG. 1 is a bottom view of a preferred embodiment of the separation unit according to the present invention.
Figure 2:
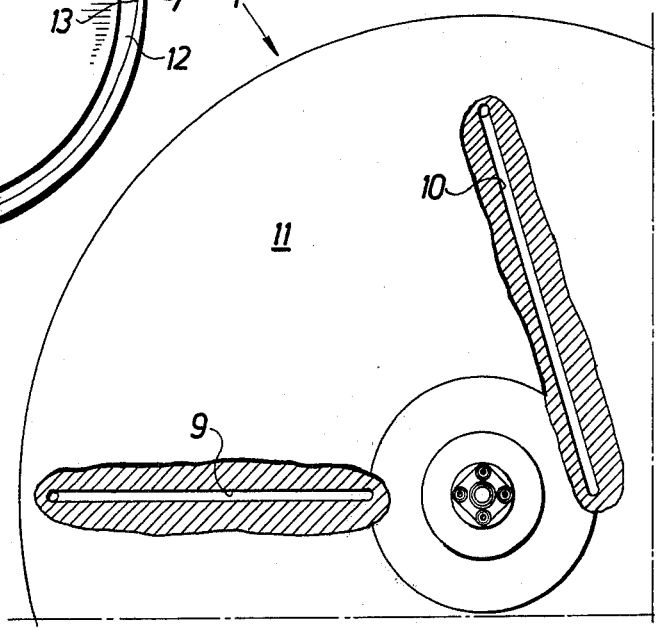
FIG. 2 is a top view of the separation unit of FIG. 1 partially broken away.

As is shown in FIGS. 1 and 2, the separation unit or disc 1 is generally circular and formed as one single piece of a rigid material, such as polycarbonate or polyamide.

On one surface 2 of the disc there is provided an elongated, curved groove comprising a central semicircular inlet portion 3 in fluid communication with a peripheral main portion 4 concentric to the center of the disc 1. Preferably, the peripheral main portion 4 is extended by a radially inwardly curved end portion 5, wherein the groove along its entire length has a smooth profile.

At the center of the disc there is formed a bore or opening 6 serving as an inlet to the inlet portion 3 of the groove 3-5.

At the separate points along the peripheral main portion 4 and/or the curved end portion 5, there are provided holes 7 and 8 forming outlets for the separated fractions.

As is shown in FIG. 2, slits or channels 9, 10 are formed on the other surface 11 of the disc 1 in fluid communication with the associated outlet hole 7 and 8, respectively.

The disc shown in FIGS. 1 and 2 comprises only two such outlet holes 7 and 8 and corresponding slits or channels 9 and 10 and is especially suitable for use in separating of whole blood into a plasma-rich fraction and a plasma-poor fraction. More precisely, the outlet hole 7 in the peripheral main portion 4 of the groove, preferably in the vicinity of the curved end portion 5, provides the outlet hole for the plasma-poor fraction (i.e., the heavy or densest fraction), while the outlet hole 8 formed in the curved end portion 5 of the groove, preferably at the end point thereof, forms the outlet hole for the plasma-rich fraction.

At the outlet hole 7 for the plasma-poor fraction, the groove comprises an expanded section 12, wherein the outlet hole 7 is provided at the wider end of the expanded section 12 while forming a radial step 13 in the groove.

The expanded section 12 forms a suitable collection chamber for the heavy fraction of the whole blood, i.e., the plasma-poor fraction, and will let the light fraction thereof, i.e., the plasma-rich fraction, pass freely. If any part of the heavy fraction will pass said collection chamber, it automatically will be drawn back as a consequence of the reducing centrifugal force due to the radially inwardly curved end portion 5. This retaining effect of the collection chamber is especially accentuated by having the outlet hole 7 for the heavy fraction in the vicinity of said curved end portion 5.

Figure 3:
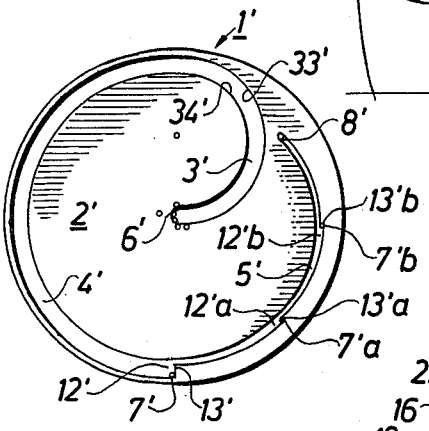
FIG. 3 is a bottom view of another preferred embodiment of the separation unit according to the present invention.

In FIG. 3 there is shown a modification of the disc according to FIGS. 1 and 2. For similar parts the same reference numbers as those used in FIGS. 1 and 2 have been used in FIG. 3, except for the addition of a "prime". This disc differs from that of FIGS. 1 and 2 as regards the number of outlet openings in the groove. As can be seen the curved end portion 5' of the groove comprises two further outlet holes 7'*a* and 7'*b* between the outlet hole 7' for the heaviest fraction and the outlet hole 8' for the lightest fraction. The further outlet holes 7'*a* and 7'*b* are used when the liquid is to be separated into four different fractions. For example, in separating whole blood, the outlet holes 7', 7'*a*, 7'*b* and 8' may be used to withdraw red cells, white cells, buffy-coat and pure plasma, respectively. As many outlet holes can be provided as fractions desired. On the other side of this disc 1', there are provided corresponding slits or channels in fluid communication with each of said outlet holes 7', 7'*a*, 7'*b* and 8'. For further details of this disc 1' reference is made to the description in connection with FIGS. 1 and 2.

The operation of the separation unit or disc 1 according to the present invention, when used in a suitable device for separating of whole blood into a plasma-rich fraction and a plasma-poor fraction, will be described in the following with reference to FIG. 4.

Figure 4:
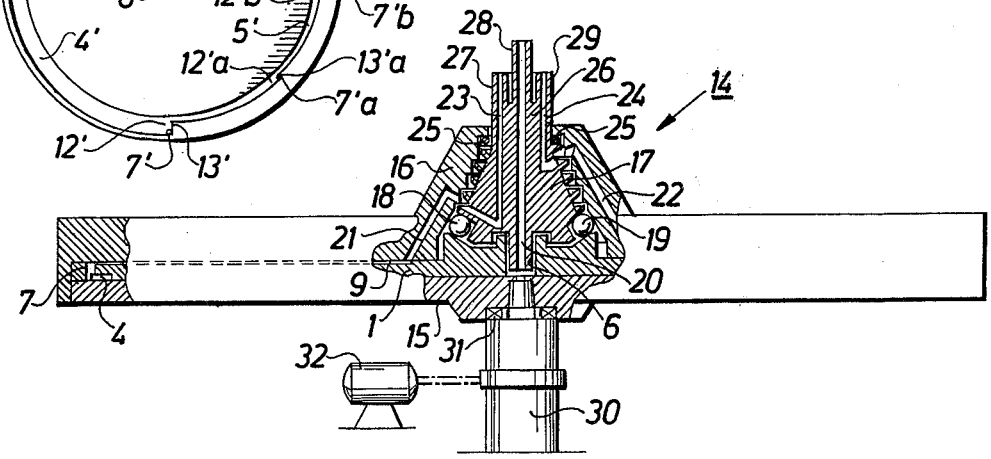
FIG. 4 is a cross-sectional view of part of a preferred embodiment of the present device, including the separation unit shown in FIGS. 1 and 2.

In FIG. 4, showing the preferred embodiment of the device 14 according to the present invention, the disc 1 is clamped or centrally located between supporting means 15 and a housing 16, wherein a centrally located transferring element 17 by means of a suitable bearing, such as glass balls 18, 19, is adapted to be stationary held between the disc 1 and the housing 16. In the transferring element 17, there is formed a vertical inlet channel 20 in fluid communication with the inlet 6 of the groove of the disc for the introduction of the liquid to be separated. Similarly, there are provided outlet passages 21, 22 in the housing 16 in fluid communication with the slits or channels 9, 10 on the top surface 11 of the disc 1 and in fluid communication with corresponding transfer outlet channels 23, 24 formed in the transferring element 17. As is shown in FIG. 4, the outlet passage 22 of the plasma-rich fraction is opened into the corresponding outlet channel 24 of the transferring element 17 on a level, which is higher than the corresponding opening of the outlet passage 21 for the plasma-poor fraction. As shown in FIG. 4, the transferring element 17 on the higher level has a narrower cross-section as compared to the level for the opening of the outlet passage 21 for the plasma-rich fraction. This arrangement is especially advantageous when a pure plasma fraction is required, since any part of the plasma-poor fraction is prevented from rising upwardly in the space between the housing and the transferring element. More exactly, any part of the plasma-poor fraction tending to flow upwardly within the space is automatically forced backwardly to the lower level due to the higher centrifugal force acting on the lower level as a result of the wider cross-section of the transferring element 17 on the lower level.

To prevent outer leakage of plasma-rich fraction from the space between the housing 16 and the transferring element 17, there is provided a seal, such as an O-ring 25 received in a suitable seat at the top of the space between the housing 16 and the transferring element 17.

As is shown in FIG. 4, the transferring element 17 comprises an outwardly extending top portion 26 comprising separate connecting nipples 27–29 to be connected to a suitable tubing to provide fluid communication between a source for the liquid to be separated and the inlet channel 20 of said transferring element 17 and between separate collection points for the separated fractions and the respective outlet channels 23, 24 of the transferring element.

In use the combination or package of supporting means 15, disc 1, housing 16 and transferring element 17 is mounted upon a drive-shaft 30 by means of a suitable bearing 31 on the bottom surface of the supporting means, wherein the drive-shaft 30 is rotated by means of any suitable motor 32 or driving means. Whole blood to be separated is pumped or otherwise introduced into the inlet channel 20 of the stationary transferring element 17 and passed into the semi-circular central portion 3 of the groove via the central opening or bore 6 of the disc 1. In the semi-circular portion 3, the whole blood is preseparated in that part of the heavy fraction (plasma-poor fraction) is concentrated towards the outer end wall 33 of the central portion, while the lighter fraction (plasma-rich fraction) in a corresponding manner is concentrated towards the opposite wall 34 thereof. The so pre-separated whole blood is transferred into the peripheral main portion 4 of the groove, wherein the actual separation will occur. At the collection chamber 12 (FIG. 1), the separated plasma poor fraction is collected and directed through the outlet opening 7 for withdrawal through the slit 9, the outlet passage 21 in the housing 16 and the corresponding transfer outlet channel 23 in the transferring element 17. The plasma-rich fraction, on the other hand, is forced to pass the collection chamber 12 and is directed into the curved end portion 5 to be withdrawn through the outlet hole 8, the slit 10, the outlet passage 22 in the housing 16 and the corresponding transfer outlet channel 24 in the transferring element 17. As explained above, any part of the plasma-poor fraction that might pass the collection chamber 12 is automatically forced backwardly to the collection chamber 12 due to the reducing centrifugal force acting in the curved end portion 5 as a consequence of the radial inward curvation of the end portion.

For further details, especially as regards the housing 16 and the transferring element 17, reference is made to our copending U.S. Patent Application entitled "Transferring Means for Use in a Device for Separating Liquids".

The device according to the present invention is especially, though not exclusively, suitable for separating of whole blood into a plasma-rich and plasma-poor fraction. By modifying the separation unit or disc, used in said device, the device may be used to separating of whole blood into any desired numbers of fractions, for example, red cells, white cells, buffy-coat and pure plasma.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A rotatable rigid disc for separating a liquid into fractions according to the densities of such fractions, said rigid disc including an inlet for the liquid to be separated; at least two outlets comprising perforating holes in said rigid disc for the separated liquid fractions; channels on one side of said rigid disc, with each channel being in fluid communication with one of said outlets; and a separation chamber in the form of an elongated, curved conduit on the other side of said rigid disc; wherein said conduit is fluidically connected to said inlet and said outlets, said outlets are positioned on said disc radially outwardly with respect to said inlet, and said outlets are positioned along said elongated, curved conduit so as to provide a separate collection location for each said outlet and so that the most dense fraction is separated by the outlet nearest along said conduit to said inlet and the least dense fraction is separated by the outlet most distal along said conduit from said inlet.

2. A rotatable rigid disc for separating a liquid into fractions according to the densities of such fractions, said rigid disc including an inlet for the liquid to be separated; at least two outlets comprising perforating holes in said rigid disc for the separated liquid fraction; channels on one side of said rigid disc, with each channel being in fluid communication with one of said outlets; and a separation chamber in the form of an elongated curved conduit on the other side of said rigid disc; wherein said conduit is fluidically connected to said inlet and said outlets, said outlets are positioned on said disc radially outwardly with respect to said inlet, and said outlets are positioned along said elongated, curved conduit so as to provide a separate collection location for each said outlet and so that the most dense fraction is separated by the outlet most radially outward from said inlet and the least dense fraction is separated by the outlet most radially inward from said inlet.

3. A device according to claim 1 or 2, wherein said conduit comprises a groove in the surface on one side of said rigid disc and wherein said disc is attached to support means covering said groove.

4. A device according to claim 3, wherein said disc is generally circular in shape.

5. A device according to claim 4, wherein said disc includes a central bore serving as said inlet to said groove.

6. A device according to claim 5, wherein said groove comprises an inlet portion and a peripheral portion, said inlet portion leading from said inlet to said peripheral portion and said peripheral portion having a shape generally curving about the periphery of said disc.

7. A device according to claim 6, wherein said peripheral portion is concentric to the center of said disc.

8. A device according to claim 6, wherein said groove includes a radially inwardly curving end portion in fluid communication with the end of said peripheral portion.

9. A device according to claim 6, wherein said holes are provided along said peripheral portion.

10. A device according to claim 8, wherein said holes are provided in said peripheral portion and in said radially inwardly curving end portion.

11. A device according to claim 9 or 10, wherein a housing is provided to surround said one side of said disc to cover said channels.

12. A device according to claim 11, wherein said channels are in fluid communication with corresponding outlet passages in said housing, wherein said outlet passages are in turn in fluid communication with corresponding housing outlet channels of a stationary element for transferring the separated fluids to a collection point.

13. A device according to claim 12, wherein said transferring element includes a transfer inlet in fluid communication with a central bore of said disc.

14. A device according to claim 8, wherein the distal most outlet hole with respect to the inlet is provided at substantially the end of said radially inwardly curving end portion and wherein another outlet hole is provided at substantially the end of said peripheral portion.

15. A device according to claim 6, wherein said inlet portion of said groove has a generally semi-circular shape.

16. A rotatable rigid disc for separating a liquid into fractions according to the densities of such fractions, said rigid disc including an inlet for the liquid to be separated; at least two outlets for the separated liquid fractions; and a separation chamber in the form of a groove in one surface of said rigid disc and curving about the periphery of said rigid disc; wherein said groove is fluidically connected to said inlet and said outlets, said outlets are positioned on said disc radially outwardly with respect to said inlet, said groove is wider radially outwardly at the point of at least one outlet than at a point distal to such outlet, thus providing a step in said groove at such outlet, and said outlets are positioned along said elongated, curved groove so as to provide a separate collection location for each said outlet and so that the most dense fraction is separated by the outlet nearest along said conduit to said inlet and the least dense fraction is separated by the outlet most distal along said conduit from said inlet.

17. A rotatable rigid disc for separating a liquid into fractions according to the densities of such fractions, said rigid disc including an inlet for the liquid to be separated; at least two outlets for the separated liquid fractions; and a separation chamber in the form of a groove in one surface of said rigid disc and curving about the periphery of said rigid disc; wherein said groove is fludically connected to said inlet and said outlets, said outlets are positioned on said disc radially outwardly at the point of at least one outlet than at a point distal to such outlet, thus providing a step in said groove at such outlet, and said outlets are positioned along said elongated, curved groove so as to provide a separate collection location for each said outlet and so that the most dense fraction is separated by the outlet most radially outward from said inlet and the least dense fraction is separated by the outlet most radially inward from said inlet.

18. A device according to claim 16 or 17, wherein said disc is attached to support means covering said groove.

19. A device according to claim 18, wherein said disc is generally circular in shape.

20. A device according to claim 19, wherein said disc includes a central bore serving as said inlet to said groove.

21. A device according to claim 16 or 17, wherein said groove in addition to said peripheral portion curving about the periphery of said disc comprises an inlet portion leading from said inlet to said peripheral portion.

22. A device according to claim 21, wherein said inlet portion of said groove has a generally semi-circular shape.

23. A device according to claim 21, wherein said peripheral portion is concentric to the center of said disc.

24. A device according to claim 23, wherein said outlets comprise perforating holes in said disc in fluid communication with corresponding channels on the opposite side of said disc, said holes being provided in said peripheral portion and in said radially inwardly curving end portion.

25. A device according to claim 24, wherein a housing is provided to surround the opposite side of said disc to cover said channels.

26. A device according to claim 25, wherein said channels are in fluid communication with corresponding outlet passages in said housing, wherein said outlet passages are in turn in fluid communication with corresponding housing outlet channels of a stationary element for transferring the separated fluids to a collection point.

27. A device according to claim 26, wherein said transferring element includes a transfer inlet in fluid communication with a central bore of said disc.

28. A device according to claim 24, wherein the distal most outlet hole with respect to said inlet is provided at substantially the end of said radially inwardly curving end portion and wherein another outlet hole is provided at substantially the end of said peripheral portion.

29. A device according to claim 21, wherein said groove includes a radially inwardly curving end portion in fluid communication with the end of said peripheral portion.

30. A device according to claim 21, wherein said outlets comprise perforating holes in said disc in fluid communication with corresponding channels on the opposite side of said disc, said holes being provided along said peripheral portion.

* * * * *